United States Patent [19]

Kowol

[11] Patent Number: 4,523,537

[45] Date of Patent: Jun. 18, 1985

[54] TWIN OR FORKED BOOM FOR A SAILING SURFBOARD

[76] Inventor: Adelheid Kowol, Gravensteinstrasse 8, D-2400 Lübeck 1, Fed. Rep. of Germany

[21] Appl. No.: 462,099

[22] Filed: Jan. 28, 1983

[30] Foreign Application Priority Data

Aug. 3, 1982 [DE] Fed. Rep. of Germany ..... 3228929
Nov. 25, 1982 [DE] Fed. Rep. of Germany ..... 3243539

[51] Int. Cl.[3] ..... B63B 15/00
[52] U.S. Cl. ..... 114/97; 114/39
[58] Field of Search ..... 114/39, 97, 98, 39.2; 24/115 G, 115 M, 129 A

[56] References Cited

U.S. PATENT DOCUMENTS 856,722 6/1907 Pedersen ..... 24/129 A

FOREIGN PATENT DOCUMENTS 2747426 4/1979 Fed. Rep. of Germany ..... 114/39
2837534 3/1980 Fed. Rep. of Germany ..... 114/39
2920011 11/1980 Fed. Rep. of Germany ..... 114/39.2
2306717 4/1975 France ..... 114/39

*Primary Examiner*—Jesus D. Sotelo
*Attorney, Agent, or Firm*—Erwin S. Teltscher

[57] ABSTRACT

The slack portion or sag of the trapezoidal member fixed by both its ends to at least one of the two twin boom tubes is variable by sleeves engaging the two slack portion end areas, embracing the twin boom tube and which are displaceable in the longitudinal direction. One end of the trapezoidal member is held in a wedge clip, so that for improving the trimming of the trapezoidal member, its engagement points are displaceable on the twin boom tube.

3 Claims, 9 Drawing Figures

Fig.1
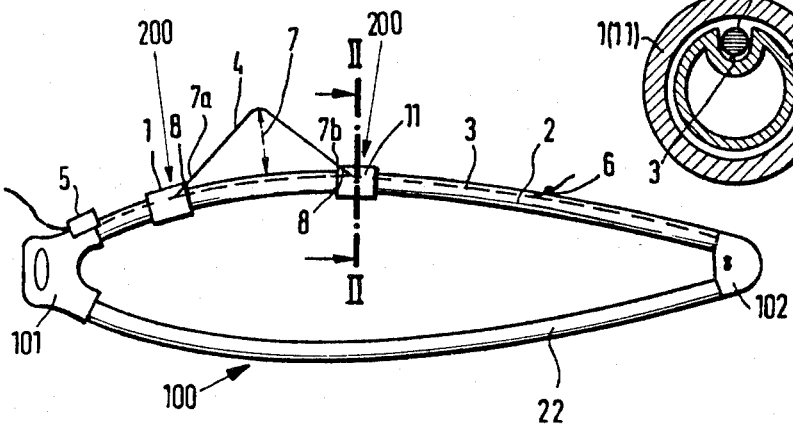
Fig.2
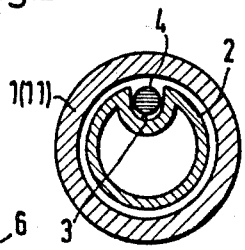
Fig.3
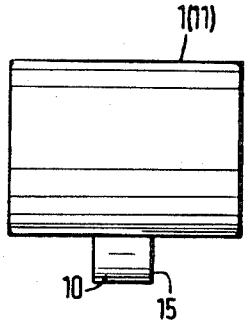
Fig.4
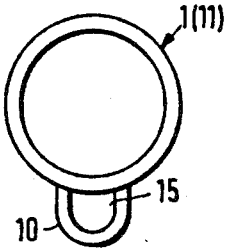
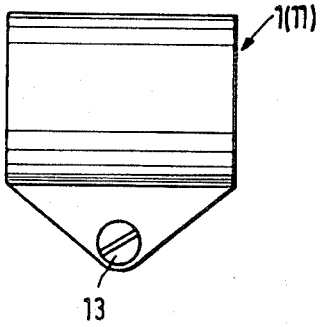
Fig.5
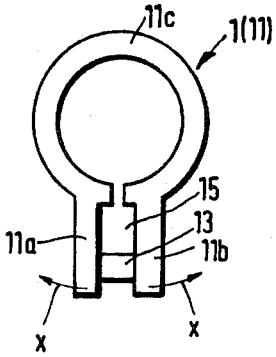
Fig.6

TWIN OR FORKED BOOM FOR A SAILING SURFBOARD

BACKGROUND OF THE INVENTION

The present invention relates to a twin boom for a sailing surfboard with a trapezoidal member fixed at at least one of its two twin boom tubes with its two ends adjacent to the rear twin boom tube connection and to the twin boom grip with a slack portion for hooking in a hook fixed to the vest, suit or retaining belt worn by the wind surfer.

It is known to fix a trapezoidal member to a twin boom tube of a twin boom of a sailing surfboard. The trapezium in conjunction with the trapezoidal member makes it possible to free the hands and arms of the surfer, if he is hooked onto the trapezoidal member by a hook fixed to a vest, suit or retaining belt worn by him, so that the sail can be held by the surfer's body. This permits surfing at high wind speed and for long periods without any fatigue to the surfer.

It is known to knot the trapezoidal member directly to the twin boom tube of the twin boom. By means of tapes which are wound several times round the twin boom tube and end in loops, or tapes which are joined in sleeve-like manner to the twin boom by adhesive fastening and have loops or by U-shaped plastic stirrups having in their end areas bores for fixing the trapezoidal member, the latter is held on the twin boom tube for forming a slack portion.

It is a disadvantage of all these constructions that the rubber covering surrounding the twin boom tube is displaced under stress and is detached. In addition, the trapezoidal member cannot be rapidly and adequately trimmed during surfing. For this purpose, the fixing points for the trapezoidal member must be released by opening the knots in order to be able to displace the fixing points and in addition the two fixing points for the trapezoidal member must be displaced in order to restore the slack portion thereof. It is necessary to trim the trapezoidal member after a sail change, on changing course, in the case of a wind change and for special surfing techniques, such as e.g. jumping.

Importance is attached in this connection to the slack portion of the trapezoidal member, the spacing of the engagement or working points of the trapezoidal member and the position of said points on the twin boom tube.

A further disadvantage is that the fixing points of the trapezoidal member to the twin boom and which are located in the gripping area of the hands have a prejudicial action. In addition, the trapezoidal member is essentially loaded in a small area by the vest hook and after a short time chafes through the trapezoidal member at this point.

BRIEF SUMMARY OF THE INVENTION

The problem of the present invention is to provide a twin or forked boom with a trapezoidal member, whose slack portion can be adapted during surfing to the prevailing conditions, which on loading is not displaced with the rubber covering of the twin boom tube and does not damage the same, whose fixing points do not have a prejudicial effect when holding the boom and which when not in use can be effortlessly pulled away, so that the surfer cannot be hooked in in an undesired manner.

The invention therefore proposes a twin boom for sailing surfboards of the aforementioned type, wherein the slack portion of the trapezoidal member is variable along the twin boom tube by means of trapezoidal member engagement point fixing devices, such as sleeves, slides, or the like acting on the two slack end areas, which embrace the twin boom tube or engage in the latter and which are displaceable in the twin boom longitudinal direction and is constructed so as to be fixable in any position by said devices.

A twin boom constructed in this way with the trapezoidal member associated therewith permits an effortless displacement of one or two engagement points of the trapezoidal member on the twin boom independently of one another for trimming purposes, without there being any significant change in the slack or sag of said member.

A further advantage is that the engagement points of the trapezoidal member on the twin boom tube of the twin boom are not loaded by longitudinal forces, so that the sensitive rubber covering surrounding the tubes and which is used for the better handling of the boom is protected. It is also advantageous that in the gripping area for the hands, there are no parts having prejudicial knots and edges and furthermore, when not in use, the trapezoidal member can be effortlessly pulled away.

Further advantageous developments of the invention can be gathered from the subclaims.

In addition, the invention also relates to an apparatus for trimming a trapezoidal member fixed by both its ends to at least one of the two twin boom tubes of a twin boom for sailing surfboards, wherein the apparatus comprises two trapezoidal member engagement point fixing devices, such as sleeves, slides, etc, which fix the two end areas of the slack portion of the trapezoidal member and are guided on the latter, as well as a wedge clip joined to one trapezoidal member end.

BRIEF DESCRIPTION OF THE DRAWINGS

The invention is described in greater detail hereinafter relative to non-limitative embodiments and the attached drawings, wherein show:

FIG. 1 a twin boom with a trapezoidal member with the device for adjusting the sag of that member on the twin boom tube in a plan view.

FIG. 2 a larger scale, vertical section along line II—II of FIG. 1.

FIG. 3 a side view of a trapezoidal adjusting device sleeve.

FIG. 4 the sleeve in a view from the front.

FIG. 5 another embodiment of a sleeve in side view.

FIG. 6 the sleeve according to FIG. 5 in a front view.

DETAILED DESCRIPTION OF THE PREFERRED EMBODIMENTS

Figure 7:
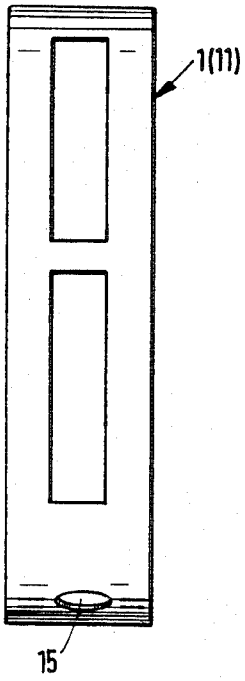
FIG. 7 a blank of another embodiment of a sleeve in a plan view.

FIG. 1 shows a per se known twin or forked boom 100 of a sailing surfboard, which is not shown in the drawing and whose two twin boom tubes are designated 2, 22. The two twin boom tubes 2, 22 are provided in the gripping area for the surfer with a non-illustrated rubber covering, which has a surface profiling. The two tubes 2, 22 are interconnected at one end by means of a twin boom grip 101 and at the rear at 102.

A trapezoidal member 4 is held on the twin boom tube 2 by means of a trapezoidal member engagement point fixing device 200 in the form of two sleeves 1, 11 in such a way that member 4 forms a slack portion or sag 7, whose two end areas *7a*, *7b* are bounded by the two sleeves 1, 11 embracing twin boom tube 2, which are displaceable in the longitudinal direction of tube 2. As a result, the sag 7 of trapezoidal member 4 is variable along the twin boom tube 2 in the case of a corresponding displacement of sleeves 1, 11. The two sleeves 1, 11 are displaceably held on the rubber covering of twin boom tube 2 (FIG. 1) and form the trapezoidal member adjusting device.

According to a preferred embodiment, the twin boom tube 2 has a groove 3 running in the longitudinal direction of the tube in which pass the trapezoidal member portions remaining on either side of sag 7 (FIGS. 1 and 2). The end of trapezoidal member 4 facing the twin boom grip 101 is fixed in a countersunk wedge clip 5, whilst the rear end is knotted in groove 3. The slack portion 7 of trapezoidal member 4 can be directly adjusted by means of clip 5. By displacing sleeves 1, 11 on twin boom tube 2, it is possible to vary the engagement points 8 of the trapezoidal member 4. In the case of loading, i.e. in the case of a pulling action on trapezoidal member 4, sleeves 1, 11 are locked on twin boom tube 2, so that sleeves 1, 11 cannot be automatically displaced on tube 2.

In the case of twin booms, whose tubes have no groove, it is possible to use the sleeve shown in FIGS. 3 and 4, which is also displaceably held in the twin boom tube, whilst the trapezoidal member 4 is passed through a loop or ring 10 fixed or shaped onto the sleeve member and whose trapezoidal member passage opening indicated at 15 receives the trapezoidal member 4.

A sleeve of the type shown in FIGS. 5 and 6 is provided for a subsequent fitting of sleeves 1, 11 to the twin boom tube of a twin boom. This sleeve 1 or 11 comprises an approximately U-shaped member, whose two approximately parallel, closely spaced legs 11*a*, 11*b* are interconnected by means of a web 11*c*, which corresponds to the cross-sectional shape of the twin boom tube (FIG. 6). This sleeve is made from resilient elastic material, such as e.g. plastics, so that the two sleeve legs 11*a*, 11*b* can be spread apart in the direction of arrow X for mounting on the twin boom tube. After mounting such a sleeve 1 or 11 on the twin boom tubes, the two legs 11*a*, 11*b* are pressed against one another and are joined by means of a screw 13. The screw connecting area is such that above the connecting point is formed the opening 15 for the passage of trapezoidal member 4.

Figure 8:
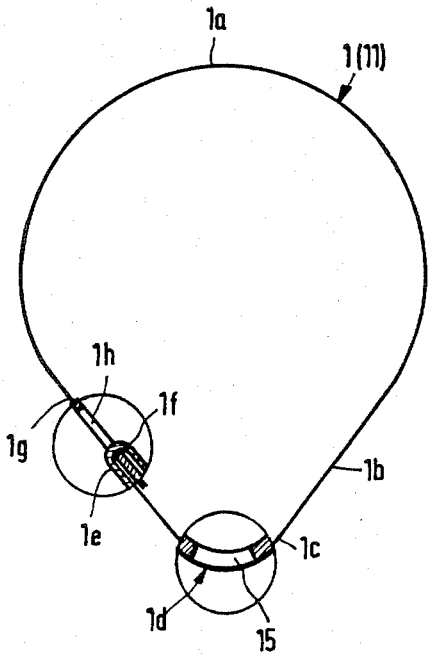
FIG. 8 a vertical section through a sleeve made from the blank according to FIG. 7.

According to the embodiment of a sleeve 1 or 11 shown in FIGS. 7 and 8, the sleeve comprises a prepared blank shown in FIG. 7 which, for forming the sleeve member, is placed around the twin boom tube in such a way that on the one hand an engagement of the sleeve wall surfaces on the outer wall surface of the twin boom tube is ensured and on the other the opening 15 provided in this construction for the passage of the trapezoidal member 4 is positioned below the twin boom tube (FIG. 8).

The sleeve 1 or 11 shown in FIG. 8 does not have to be shaped from the blank shown in FIG. 7 by the surfer. The sleeve can be supplied in the state shown in FIG. 8 and is mounted on the twin boom tube by the surfer after opening the clamp-like sleeve. The two ends of the sleeve are then joined by means of a hook lock in such a way that it is possible to subsequently release sleeve 11.

The sleeve shown in FIG. 8 comprises an arcuate portion 1*a*, whereof one end 1*b* passes into a bent portion 1*c* having in the angular area 1*d* the trapezoidal member passage opening 15 and at its free end 1*e* a hook-like engagement member 1*f*, which can be hooked into an engagement slot 1*h* formed at the other end 1*g* of the arcuate sleeve portion 1*a*.

Whereas in the case of the embodiment shown in FIG. 1 only one of the two twin boom tubes carries a trapezoidal member 4, the possibility also exists of correspondingly providing the other tube with a trapezoidal member and sleeves 1, 11, so that a slack portion or sag 7 is also formed in the trapezoidal member area between the two sleeves 1 and 11. This sag 7 is used for fixing a hook, which is secured to the vest, suit or retaining belt worn by the surfer, so that he can hold by means of his body the sail guided and held between the two twin boom tubes, thereby freeing his hands and arms.

The sleeves 1, 11 arranged on one or both twin boom tubes 2, 22 can be displaced into the in each case desired position independently of one another after releasing trapezoidal member 4. There is thereby virtually no change to the sag 7 of member 4. This also applies if only one of the two sleeves 1, 11 arranged on twin boom tube 2 or 22 is moved. Thus, independently of the chosen sail, the centreboard and fin equipment, the wind conditions and the surfing technique, it is effortlessly possible to find and adjust the ideal position of the trapezoidal member. After releasing member 4 from the wedge clip 5, the sag 7 can be adjusted in a random manner and then fixed again in the desired or selected magnitude. If there is deliberately to be no hooking into the trapezium, the slack portion 7 can be drawn away by means of the trapezoidal member portion between clip 5 and the adjacent sleeve 1, so that there can be no undesired hooking in.

Sleeves 1 and 11 are provided with a surface profiling, in order to increase the grip of the sleeves during manual displacement.

Figure 9:
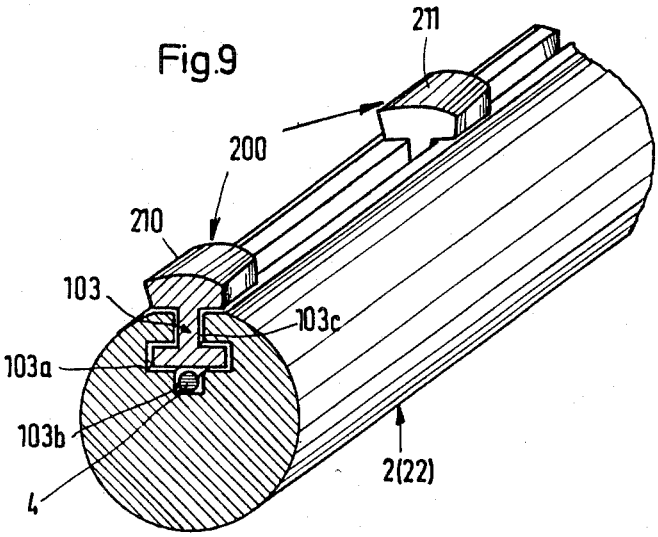
FIG. 9 a twin boom tube with another embodiment of a device for adjusting the trapezoidal member sag, partly in vertical section and partly in diagrammatic form.

A further embodiment of a device for fixing the engagement points 8 for the trapezoidal member sag 7 on one of the two twin boom tubes 2 or 22 is shown in FIG. 9. Twin boom tube 2 is provided with a groove 103 running in the longitudinal direction of the boom, whose cross-sectional profile comprises a wider portion 103*a*, which is followed by a lower, narrower portion 103*b*, for receiving trapezoidal member 4, whilst in the upper region, portion 103*a* passes into a portion 103*c* tapered in neck-like manner. Two slides 210,211 are held in guide groove 103 in such a way that the trapezoidal member portions located in the vicinity of slides 210,211 are pressed against the guide groove wall faces and in this way are secured in position. In addition, slides 210, 211 can also be provided with fixing devices, not shown in the drawings, such as e.g. clamping screws or the like.

Slides 210, 211 are held in guide groove 103. Each slide has a cross-sectional profile corresponding to the guide groove cross-sectional profile. In the embodiment of FIG. 9, each slide 210, 211 has a double T-shaped cross-sectional profile. At the top, guide groove 103 has at least one closable insertion opening, so that the slide can be inserted into guide groove 103. Guide groove 103 can be formed in the twin boom tube of the twin boom in such a way that the slot-like guide groove opening can be positioned at the top or bottom.

What is claimed is:

1. An apparatus adapted to connect first and second portions of a substantially trapezoidal member to at least one twin tube of a twin boom, said trapezoidal member having a normally slack portion spaced at an adjustable spacing from said at least one twin tube, and including first and second end portions, the twin boom being used in connection with a sailing surfboard, comprising in combination first and second trapezoidal member engagement means slideably connected to said first and second trapezoidal member portions, respectively, each trapezoidal member engagement means including a sleeve, at least one of the sleeves being shaped as an approximately U-shaped clamping profile body defining profile member legs, and, accompanied by the formation of a trapezoidal member passage opening is adapted to be closed by means of a screw holding together the profile member legs, said trapezoidal member engagement means being adapted to slideably engage said at least one twin tube, a wedge-formed clip connected to said first end portion, and adapted to be disposed on said at least one twin tube, said second end portion being adapted to be connected to said at least one twin tube at a distance from said clip, whereby said clip serves to adjust and fix the spacing of said normally slack portion from said at least one twin tube.

2. An apparatus adapted to connect first and second portions of a substantially trapezoidal member to at least one twin tube of a twin boom, said trapezoidal member having a normally slack portion spaced at an adjustable spacing from said at least one twin tube, and including first and second end portions, the twin boom being used in connection with a sailing surfboard, comprising in combination first and second trapezoidal member engagement means slidably connected to said first and second trapezoidal member portions, respectively, adapted to slideably engage said at least one twin tube, and a wedge-formed clip connected to said first end portion, and adapted to be disposed on said at least one twin tube, said second end portion being adapted to be connected to said at least one twin tube at a distance from said clip, wherein the twin tube receiving the trapezoidal member is provided with a guide groove extending in the twin tube longitudinal direction for displaceably mounting said trapezoidal member engagement means, said trapezoidal member engagement means having the form of two displaceable slides or the like, whereby said clip serves to adjust and fix the spacing of said normally slack portion from said at least one twin tube.

3. An apparatus according to claims 2, wherein the guide groove in the twin boom tube has an approximately rectangular portion in cross-section followed at the bottom by a depression for receiving the trapezoidal member, the rectangular portion passing in its upper area into a portion tapered in neck-like manner and each of the two slides has an approximately double T-shaped cross-sectional profile.

* * * * *